US008702541B2

(12) United States Patent
Calzolari et al.

(10) Patent No.: US 8,702,541 B2
(45) Date of Patent: Apr. 22, 2014

(54) APPARATUS AND METHOD FOR THE GAME OF BASEBALL FOR THE BLIND

(75) Inventors: Umberto Calzolari, Bologna (IT); Ottavio Gandolfi, Bologna (IT)

(73) Assignee: AIBxC Onlus—Associazione Italiana Baseball giocato da Ciechi (IT)

( * ) Notice: Subject to any disclaimer, the term of this patent is extended or adjusted under 35 U.S.C. 154(b) by 146 days.

(21) Appl. No.: 13/419,850

(22) Filed: Mar. 14, 2012

(65) Prior Publication Data

US 2012/0252608 A1 Oct. 4, 2012

(30) Foreign Application Priority Data

Mar. 31, 2011 (IT) ..... BO2011A0167

(51) Int. Cl.
*A63B 71/00* (2006.01)
*A63B 69/00* (2006.01)

(52) U.S. Cl.
USPC ..... 473/499; 473/422

(58) Field of Classification Search
USPC ..... 473/422, 570, 451, 468, 571, 615, 458, 473/500, 415, 497, 452
See application file for complete search history.

(56) References Cited

U.S. PATENT DOCUMENTS

| | | | | |
|---|---|---|---|---|
| 2,379,006 | A * | 6/1945 | Johnson | 473/568 |
| 3,137,504 | A * | 6/1964 | Zordan et al. | 473/457 |
| 3,578,801 | A * | 5/1971 | Piazza | 473/457 |
| 4,005,864 | A * | 2/1977 | Stewart | 473/437 |
| 4,380,759 | A * | 4/1983 | Sulkoski et al. | 340/407.1 |
| 4,777,474 | A * | 10/1988 | Clayton | 340/539.11 |
| 5,452,889 | A * | 9/1995 | Lewinski et al. | 473/519 |
| 5,590,875 | A * | 1/1997 | Young | 473/457 |
| 6,050,908 | A * | 4/2000 | Muhlhausen | 473/457 |
| 6,117,031 | A | 9/2000 | Malinauskas et al. | |
| 6,254,502 | B1 * | 7/2001 | Becker | 473/594 |
| 6,302,813 | B1 * | 10/2001 | Sturgeon et al. | 473/564 |
| 6,561,930 | B2 * | 5/2003 | Mabry | 473/457 |
| 6,923,737 | B1 * | 8/2005 | Walker | 473/457 |
| 7,147,580 | B2 * | 12/2006 | Nutter et al. | 473/457 |
| 2001/0034275 | A1 * | 10/2001 | Dunnack et al. | 473/457 |
| 2006/0276270 | A1 * | 12/2006 | Haney | 473/457 |
| 2010/0102938 | A1 * | 4/2010 | Delia et al. | 340/326 |

OTHER PUBLICATIONS

Massof Robert W: "Auditory assistive devices for the blind" In: "Proceedings of the 2003 International Conference on Auditory Display", Jul. 6, 2003, XP002664985, pp. 271-275.
Italian Search Report dated Dec. 2, 2011 from counterpart application.

* cited by examiner

*Primary Examiner* — Mitra Aryanpour
(74) *Attorney, Agent, or Firm* — Timothy J. Klima; Shuttleworth & Ingersoll, PLC

(57) ABSTRACT

An apparatus for the game of baseball for the blind comprises a base for the game of baseball for the blind comprising: sound reproduction means; and a control and operating unit, connected to the sound reproduction means for activating a reproduction of a sound depending on a control signal, the apparatus further comprising a control device, equipped with a control push-button, operatively connected to the control and operating unit for allowing a user to transmit the control signal to the control and operating unit.

19 Claims, 2 Drawing Sheets

APPARATUS AND METHOD FOR THE GAME OF BASEBALL FOR THE BLIND

This application claims priority to Italian Patent Application BO2011A000167 filed Mar. 31, 2011, the entirety of which is incorporated by reference herein.

BACKGROUND OF THE INVENTION

This invention relates to an apparatus and a method for the game of baseball for the blind.

The game of baseball is particularly well-known and widespread all over world. In light of that, to make this sport accessible even to the blind, a variation on traditional baseball was developed for blind players (hereinafter referred to in this description with the term baseball for the blind).

The game of baseball for the blind is a sport similar to traditional baseball but has rules or devices specifically devised to allow blind people to be able to play that sport while having fun and in absolute safety.

For example, in baseball for the blind there is no pitcher. The ball is thrown into the air directly by the blind batter and the ball is of a special type able to emit sounds during its movement.

As is known, in baseball the players in the attacking team (the team with a batter at "home base"), in order to increase their score, move between the bases ("first base", "second base", "third base") so as to travel a full circuit of the field (diamond) without being eliminated.

One of the main difficulties encountered by the blind is that linked to movement—at running speed—from one base to the next.

Until now, that problem was solved by having sighted people on the field who, by providing indications of various kinds (clapping their hands, or objects such as paddles, etc.), guide the blind player from one base to the next.

However, such indications are not always suitable and effective for that purpose.

The article by Robert W. Massof relative to the International Conference on Auditory Display, Boston, Mass., USA, 6-9 Jul. 2003 illustrates a system comprising a sound base which is activated after the blind player has hit the ball.

The disadvantage of that system is that it does not allow optimum guidance. In fact, the blind player may have difficulty reaching the base if he uses only the sound indication.

SUMMARY OF THE INVENTION

Therefore, the aim of this invention is to overcome these disadvantages by providing a base and an apparatus for the game of baseball for the blind which allows a blind player to move along the field in an effective and precise way.

Accordingly, this invention achieves that aim with an apparatus comprising the technical features described in one or more of the appended claims.

BRIEF DESCRIPTION OF THE DRAWINGS

The technical features of this invention, according to the above-mentioned aims, may be clearly inferred from the content of the appended claims, and the advantages of this invention are more apparent from the detailed description which follows, with reference to the accompanying drawings, which illustrate a non-limiting embodiment of the invention provided by way of example only, in which:

DESCRIPTION OF THE PREFERRED EMBODIMENTS

Figure 1:
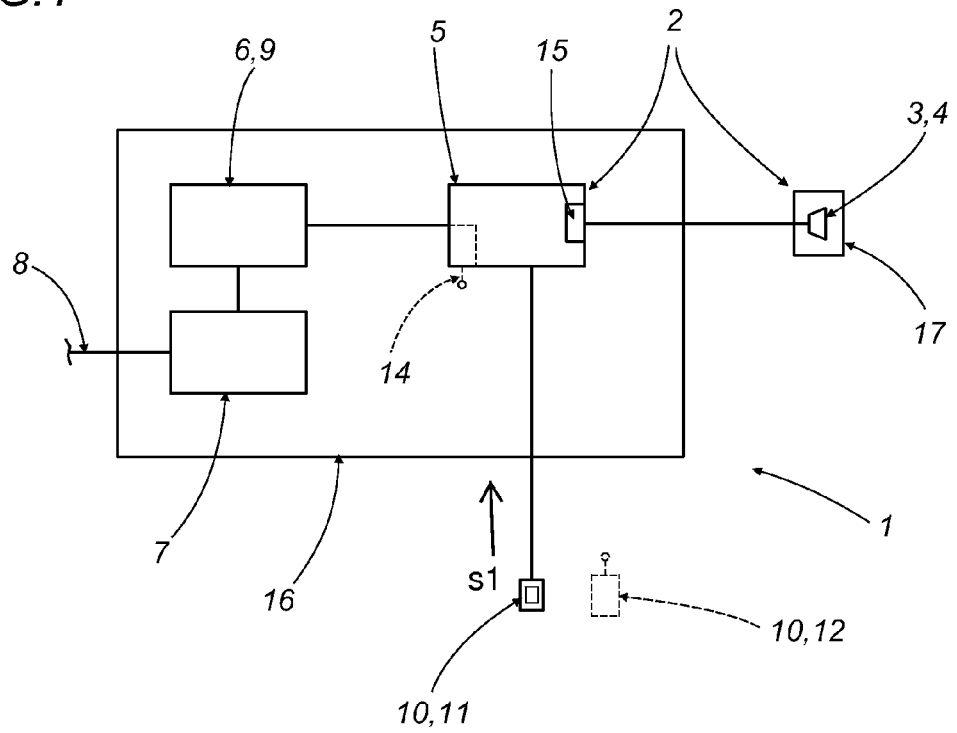
FIG. 1 is a functional diagram of the apparatus for baseball for the blind according to this invention.

In FIG. 1 the numeral 1 denotes an apparatus for the game of baseball for the blind.

According to the invention, the apparatus 1 comprises a base 2 for the game of baseball for the blind which in practice is positioned close to one of the "bases" of the playing field (for example at "first base" B1 of the playing field CG).

The base 2 comprises a loudspeaker 4, designed for sound reproduction, that is to say, to generate a sound.

According to the invention, the loudspeaker 4 more generally forms sound reproduction means 3. In fact, the loudspeaker 4 may be substituted with a buzzer or any other electroacoustic device able to generate a sound.

The base 2 also comprises a control and operating unit 5, connected to the sound loudspeaker 4 (that is to say, to the sound reproduction means 4) for activating sound generation by the loudspeaker 4.

The base 2 also comprises a battery 6 and a battery charger 7 which can be connected to an electric mains network 8 to allow the battery 6 to be recharged.

More generally, the battery 6 forms means 9 for powering both the control and operating unit 5 and the active electronic components of the base 2 (e.g.: loudspeaker 4, etc.).

It should be noticed that the apparatus 1 also comprises a control device 10, which can be activated by a user—who is normally a prompter not a player, and is sighted —, or preferably an umpire, for sending a control signal s1 to the control and operating unit 5.

Preferably, the control signal s1 is a logic signal (even more preferably binary).

It should be noticed that the control and operating unit 5 is designed to activate the emission of a sound as a result of receiving the control signal s1.

Alternatively, according to another embodiment, the control signal s1 is an analogue signal and the control and operating unit 5 is designed to generate a sound depending on the actual value of the analogue signal s1.

It should be noticed that according to that embodiment it is possible, using the analogue signal s1, to modulate the sound emitted by the loudspeaker 4 in such a way as to provide a guiding indication to the blind player as he moves at a run (for example guiding information useful to the blind player in order to understand whether or not he is travelling along the correct trajectory).

However, irrespective of the type of signal s1 (logic or analogue) one advantage of the apparatus 1 is that the control device 10 allows the sighted user to provide guiding indications which are useful to the blind player, after training the blind player to associate a predetermined instruction with a particular sound or sound frequency.

For example, the user may generate an intermittent sound if the blind player is on the correct trajectory towards the base (in that case the instruction associated with this sound is "keep running in the same direction") or a continuous or low frequency sound if the blind player is not on the correct trajectory (in which case the instruction associated with this sound is "change the direction you are running in"). In that way, the sighted user can guide the blind player towards the base.

It should be noticed that such a system is particularly effective and allows blind players to be guided to the base substantially with greatly reduced margins of error.

Activation of sound emission, depending on reception of the control signal s1, can be programmed according to three different modes:

i) the control and operating unit 5 activates the sound emission after receiving the control signal s1 and keeps the sound emission activated for the entire duration of the control signal s1 (that is to say, for as long as the user keeps the control device 10 activated, sending the control signal to the unit 5);

ii) the control and operating unit 5 activates the sound emission when it receives a first control signal s1' and deactivates the sound emission when it receives a subsequent second control signal s1";

iii) the control and operating unit 5 activates the sound emission after receiving the control signal s1 and keeps the sound emission activated for a predetermined period of time (which can preferably be set).

It should be noticed that such operating modes (i, ii and iii) can be set by suitably selecting/programming the control and operating unit 5, for example by setting a dip-switch.

It should be noticed that the control device 10, according to a first embodiment, comprises a control push-button 11 which is electrically connected to the control and operating unit 5, for sending the control signal s1.

It should be noticed that, preferably, the control push-button is connected to the control and operating unit 5 by a cable (having any length).

It should also be noticed that the expression "control push-button" shall also be understood to mean a switch or lever or more generally an element which can be operated by the user to send the control signal s1 to the control and operating unit 5.

According to a second embodiment of the control device 10, the device 10 comprises a remote control unit 12, equipped with means for wirelessly transmitting the control signal s1 to the control and operating unit 5 (preferably using radio waves).

The control device 10 is equipped with the control push-button, which can be activated by the user for sending the control signal s1 to the control and operating unit 5.

According to that embodiment, the control and operating unit 5 is equipped with wireless receiver means 14 for the control signal s1.

It should be noticed that in FIG. 1 the remote control unit 12 and the wireless receiver means 14 are illustrated with dashed lines.

It should be noticed that the presence of the control push-button allows a sighted person to guide a blind player towards the base, after the blind player has been trained to associate a predetermined instruction with a predetermined sound (as described above).

Moreover, another technical effect associated with the control device equipped with the control push-button is that it is possible to generate a sound depending on the distance between the blind player and the base. For example, it is possible for the control push-button user to generate a continuous sound when the blind player is far from the base and to increase the frequency of the sound as the player gets closer to the base.

According to another aspect, the control device equipped with the control push-button allows a sighted user to generate a sound at a preset frequency depending on the blind player. That may allow the generation of a continuous or intermittent sound at a predetermined frequency, depending on the blind player (that sound is generated so as to favor the hearing sensitivity of the blind player).

Preferably the wireless receiver means 14 for the control signal s1 comprise a superheterodyne receiver device.

The following is a description, by way of example and without limiting the scope of the invention, of operation of the apparatus 1 with reference to positioning of the apparatus 1 at "first base" B1 of the playing field CG.

The blind batter, after validly hitting a ball, starts his run from "home base" B0 towards "first base" B1.

A user U1—normally an umpire—positioned on the playing field CG sends a control signal s1 to the control and operating unit 5.

It should be noticed that the control and operating unit 5 controls the loudspeaker 4 in such a way that the latter generates a sound, which can be heard by the blind runner.

The blind runner, thanks to the sound generated by the loudspeaker 4, is therefore guided on his run from "home base" B0 towards "first base" B1 with extreme precision and accuracy.

It should be noticed that, even in the presence of noise constituting interference, the blind player easily makes out the sound emitted by the loudspeaker 4.

In fact, preferably and advantageously, the sound emitted by the loudspeaker 4 is an intermittent sound (that is to say, a sound pulse), which can be easily distinguished from other sounds.

According to another aspect of the invention, the control and operating unit 5 comprises means 15 for setting the sound.

Said means 15 for setting the sound are designed to allow adjustment of the sound emitted by the loudspeaker.

Preferably the sound setting means 15 allow adjustment of the duration of the pulse (correlated to the frequency of the sound).

Preferably the sound pulses have a duration of between 200 ms and 2000 ms.

It should be noticed that, advantageously, the presence of means 15 for setting the sound allows the sound to be set for two or more bases 2 in such a way as to allow players to distinguish between one base and another. That allows a first base 2 to be positioned at "first base", a second base 2 at "second base" and a third base 2 at "third base".

Figure 2:
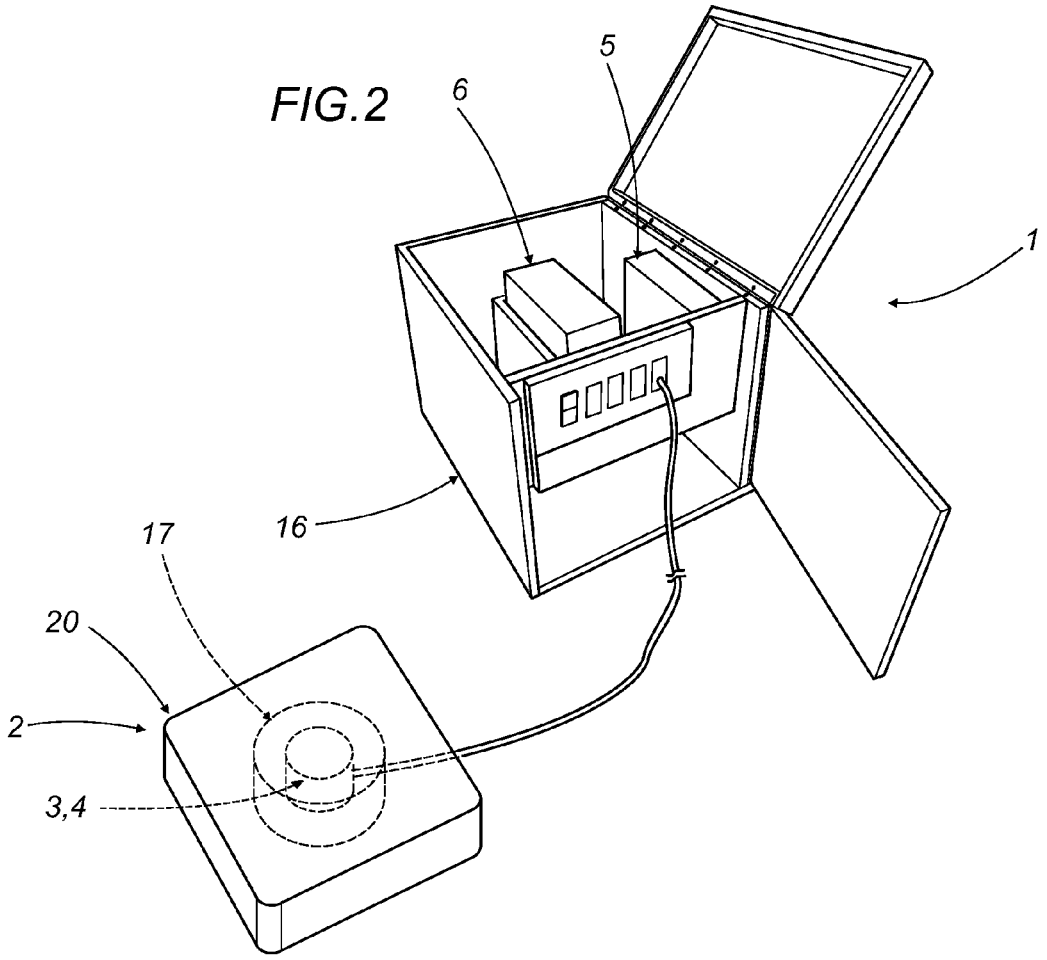
FIG. 2 is a perspective view of a preferred embodiment of the apparatus for baseball for the blind according to this invention.
Figure 3:
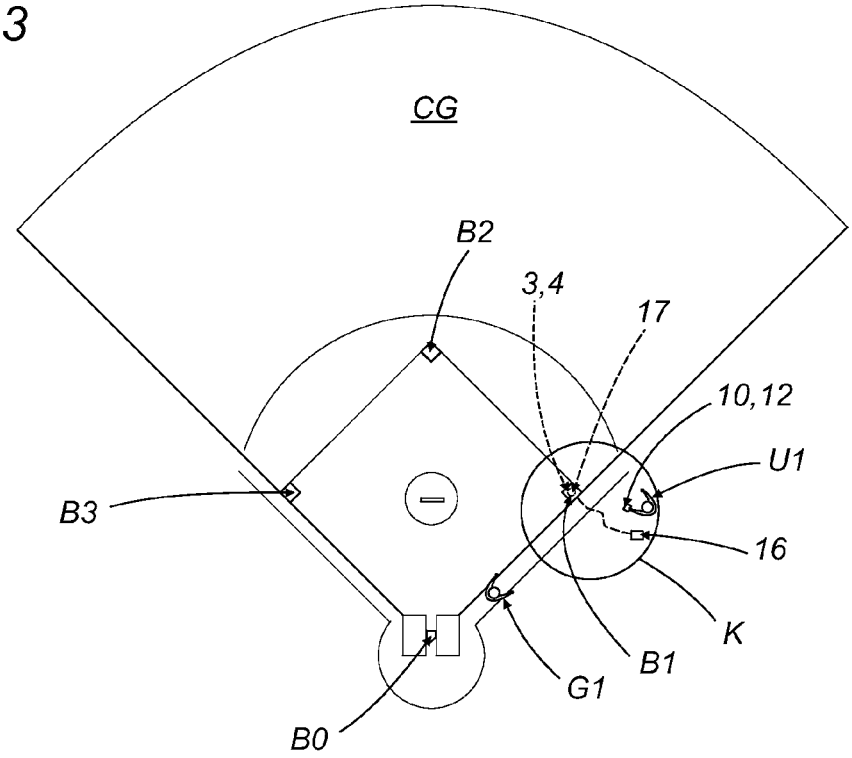
FIG. 3 is a plan view of a baseball playing field in which the apparatus according to this invention is used.
Figure 4:
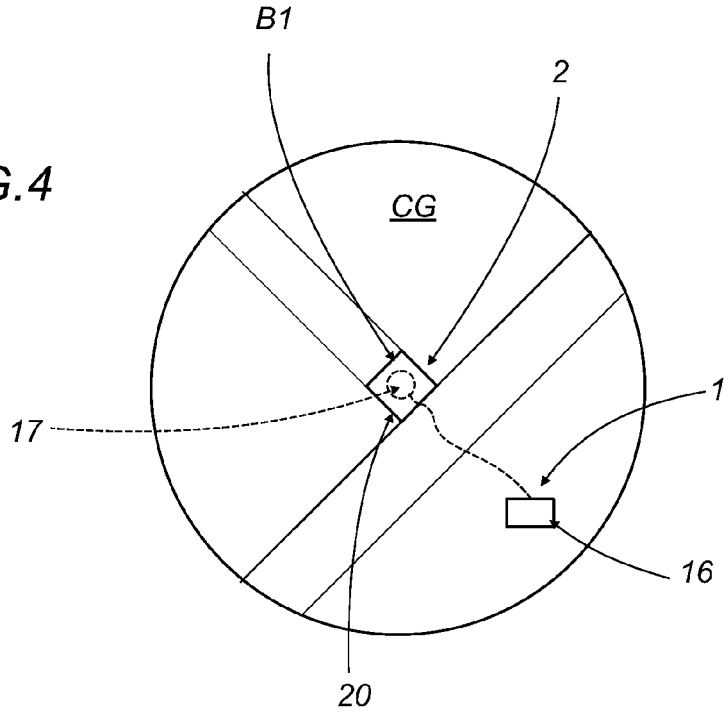
FIG. 4 illustrates a detail K from FIG. 3.

FIG. 2 shows a preferred embodiment of the apparatus 1.

It should be noticed that, preferably, the apparatus 1 comprises a box-shaped container 16.

The box-shaped container 16 is designed to house the components of the base 2, that is to say the battery 6, the battery charger 7, the control and operating unit 5 and the loudspeaker 4.

In particular, according to a preferred embodiment, the battery 6, the battery charger 7 and the control and operating unit 5 are fixed to the box-shaped container 16 while the loudspeaker 4 can be removed from the container 16.

It should be noticed that the container 16 can easily be transported by a user, in such a way that the apparatus 1 can be removed from the playing field CG at the end of the game.

Advantageously, that allows the loudspeaker 4 to be positioned in an area of the playing field CG in which it forms one (B1, B2, B3) of the bases of the playing field CG and the box-shaped container 16 to be positioned at a distance from the loudspeaker 4, with the double advantage of preventing the blind player from bumping into the box-shaped container 16 during his run and of allowing the blind player to identify with great precision the exact position of the base (B1, B2, B3) of the playing field CG.

According to another aspect, the loudspeaker 4 is positioned inside a protective body 17 (usually rigid). It should be noticed that, advantageously, the body 17 allows the loudspeaker to be protected when it is positioned in the exact physical position of one of the bases (B1, B2, B3) of the playing field CG.

The protective body 17 can preferably be removed from the box-shaped container 16.

It should be noticed that, preferably, placed on top of the protective body 17 there is a pad 20 (illustrated in FIG. 2), preferably comprising a rigid sheet with a plurality of holes and with a sheet of resilient material over it (not illustrated).

The invention described above is susceptible of industrial application and may be modified and adapted in several ways without thereby departing from the scope of the inventive concept. Moreover, all the details of the invention may be substituted by technically equivalent elements.

What is claimed is:

1. An apparatus for the game of baseball for the blind, comprising:
   - a base;
   - a sound reproduction device;
   - a control and operating unit, operatively connected to the sound reproduction device for activating a reproduction of a sound depending on a control signal;
   - a control device, equipped with a control push-button, operatively connected to the control and operating unit for transmitting the control signal to the control and operating unit, the control push-button being constructed and arranged such that operation of the control push-button controls the control and operating unit to vary the reproduction of the sound to provide audible guiding indications for assisting a blind player reach the base.

2. The apparatus according to claim 1, wherein the base comprises an electrical power supply for powering the control and operating unit.

3. The apparatus according to claim 1, wherein the control and operating unit is constructed and arranged to set the sound reproduced by the sound reproduction device.

4. The apparatus according to claim 3, wherein the control and operating unit activates the reproduction of the sound as a sound pulse and is constructed and arranged to adjust a duration of the sound pulse.

5. The apparatus according to claim 1, wherein the control device comprises a wireless transmitter for wirelessly transmitting the control signal and the control and operating unit is equipped with a wireless receiver for the control signal.

6. The apparatus according claim 1, wherein the control push-button is electrically connected to the control and operating unit.

7. The apparatus according to claim 1, comprising a box-shaped container, which can be transported by a user, for housing the sound reproduction device.

8. The apparatus according to claim 7, comprising a protective body for the sound reproduction device, which can removed from the box-shaped container and positioned on the playing area in such a way as to at least partly form a playing base of the playing field.

9. The apparatus according to claim 1, wherein the control and operating unit activates the generation of the sound for a predetermined time as a result of receiving the control signal.

10. The apparatus according to claim 1, wherein the control and operating unit activates the generation of the sound as a result of receiving a first control signal and deactivates generation of the sound as a result of receiving a second control signal subsequent to the first control signal.

11. A method for allowing a blind user to be directed to a base on a baseball playing field, comprising:
   - preparing a sound reproduction device at the base;
   - preparing a control and operating unit, connected to the sound reproduction device for activating a reproduction of a sound depending on a control signal;
   - preparing a control device, which can be activated by a user for sending the control signal to the control and operating unit;
   - activating the control device for sending the control signal to the control and operating unit;
   - activating the sound reproduction device for generating a sound when the control and operating unit has received the control signal;
   - controlling the control device with a control push-button to control the control and operating unit to vary the reproduction of the sound to provide audible guiding indications for assisting a blind player reach the base.

12. The apparatus according to claim 2, wherein the control and operating unit is constructed and arranged to set the sound reproduced by the sound reproduction device.

13. The apparatus according to claim 12, wherein the control and operating unit activates the reproduction of the sound as a sound pulse and is constructed and arranged to adjust a duration of the sound pulse.

14. The apparatus according to claim 13, wherein the control device comprises a wireless transmitter for wirelessly transmitting the control signal and the control and operating unit is equipped with a wireless receiver for the control signal.

15. The apparatus according claim 14, wherein the control push-button is electrically connected to the control and operating unit.

16. The apparatus according to claim 15, comprising a box-shaped container, which can be transported by a user, for housing the sound reproduction device.

17. The apparatus according to claim 16, comprising a protective body for the sound reproduction device, which can removed from the box-shaped container and positioned on the playing area in such a way as to at least partly form a playing base of the playing field.

18. The apparatus according to claim 17, wherein the control and operating unit activates the generation of the sound for a predetermined time as a result of receiving the control signal.

19. The apparatus according to claim 17, wherein the control and operating unit activates the generation of the sound as a result of receiving a first control signal and deactivates generation of the sound as a result of receiving a second control signal subsequent to the first control signal.

* * * * *